US006860825B2

(12) United States Patent
Clark

(10) Patent No.: US 6,860,825 B2
(45) Date of Patent: Mar. 1, 2005

(54) GAME COMBINING STRATEGY AND BALL KICKING SKILLS

(75) Inventor: Harvey P. Clark, Boylston, MA (US)

(73) Assignee: Mondi Enterprises Inc., Boylston, MA (US)

( * ) Notice: Subject to any disclaimer, the term of this patent is extended or adjusted under 35 U.S.C. 154(b) by 0 days.

(21) Appl. No.: 10/628,595

(22) Filed: Jul. 28, 2003

(65) Prior Publication Data

US 2004/0072635 A1 Apr. 15, 2004

Related U.S. Application Data

(60) Provisional application No. 60/404,400, filed on Aug. 19, 2002.

(51) Int. Cl.[7] ..... A63B 63/00

(52) U.S. Cl. ..... 473/478; 273/400

(58) Field of Search ..... 383/117, 38, 39, 383/40; 473/478, 476, 415, 490, 491–495, 422; 273/394, 398, 400

(56) References Cited

U.S. PATENT DOCUMENTS

| | | | | | |
|---|---|---|---|---|---|
| 713,275 | A | * | 11/1902 | Arkins | 273/394 |
| 1,527,988 | A | * | 3/1925 | McMurtrie | 273/400 |
| 3,822,883 | A | * | 7/1974 | De Vos | 273/400 |
| 4,326,722 | A | * | 4/1982 | Dickens | 273/400 |
| 5,012,963 | A | * | 5/1991 | Rosenbaum | 224/407 |
| D420,074 | S | * | 2/2000 | Whitham-Taudien | D21/705 |

* cited by examiner

*Primary Examiner*—Gregory Vidovich
*Assistant Examiner*—M. Chambers
(74) *Attorney, Agent, or Firm*—Brian M. Dingman, Esq.; Mirick, O'Connell, DeMallie & Lougee, LLP

(57) ABSTRACT

A game requiring and enhancing ball kicking accuracy, to accomplish the desired result of being the first of two alternating players to kick a soccer ball into, and win possession of, three consecutive squares in a frame consisting of nine square openings, arranged three vertically by three horizontally.

15 Claims, 4 Drawing Sheets

GAME COMBINING STRATEGY AND BALL KICKING SKILLS

CROSS REFERENCE TO RELATED APPLICATION

This application claims priority of Provisional application Ser. No. 60/404,400, filed on Aug. 19, 2002.

FIELD OF THE INVENTION

This invention relates to a game that involves kicking a soccer-type ball into various compartments of a soccer-type net.

BACKGROUND OF THE INVENTION

Soccer is a game that is actively played by a large segment of the population, of this and other countries. The sport enjoys continuing rapid growth, not only via participation, but also increasingly as a professional spectator sport. Improvement of soccer kicking skills is an objective of any soccer player.

SUMMARY OF THE INVENTION

The product of the invention is designed to combine the strategy of Tic-Tac-Toe, with the activity of kicking a soccer-type ball toward a combination of soccer-type nets, creating a fin activity for virtually all ages, while improving soccer kicking skills. It is thus the primary objective of this invention to provide a soccer-type goal, consisting of a frame and netting (the frame may be made of plastic pipes), which together define multiple symmetric, preferably rectangular, compartments to use as targets for kicking a soccer-type ball into, to strategically become the first of two players (or teams) to win three consecutive compartments, in a manner comparable to the age-old game of Tic-Tac-Toe, historically played with a pen or pencil and paper.

The invention includes a symmetric frame configuration, in one embodiment formed from sections of pipe, connected with various types of joints, and covered with a set of nets of various sizes, to form pockets to catch and hold a soccer-type ball, when it is kicked properly into one of the compartments. There may be a cone-like stand for the ball to assist in kicking the ball.

When a compartment has been secured by one of two players, each of whom is attempting to secure possession of three consecutive compartments by kicking the ball toward one section of the goal, a marker of a specific shape, color or other indicia can be placed in the secured compartment in place of the ball, to indicate possession as the game proceeds. The game continues until a player is able to secure three consecutive compartments, or until all of the compartments of the goal have been secured, and marked with the two different symbols, in which case the player with the majority of compartments secured, as marked by their specific symbols, can be declared the winner.

The frame of the goal may be supported by side braces, so that it rests at an angle to the ground, with anchors (which may be plastic, similar to tent stakes) securing it to the ground surface, keeping it stable.

The option exists to permanently assemble the goal-frame by adhering the frame sections with a bonding agent, or mechanically interfitting the sections together, so that the frame can be disassembled for storage or transporting.

BRIEF DESCRIPTION OF THE DRAWINGS

Some of the features and advantages of the invention have been previously stated. Others will become apparent from the description and the following drawings, in which:.

DETAILED DESCRIPTION OF THE PREFERRED EMBODIMENT

Figure 1:
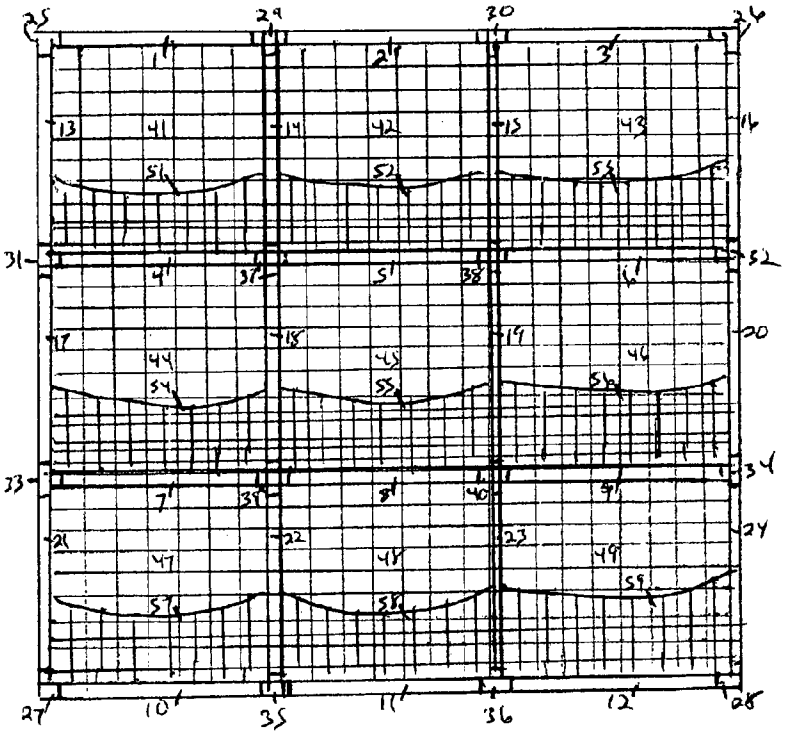
FIG. 1 is a front view of the preferred embodiment of the game and training device of the invention, showing the configuration of the front of the frame, and the configuration of nets which form the pockets, with the ball and cone-stand nearby.

In the preferred embodiment of the invention a ball is kicked into a receptacle comprising of a frame closed by a net and divided into nine compartments in a 3×3 matrix. Each compartment is larger than a soccer ball. The target is arranged so that if a ball is properly kicked into one of the compartments, it is captured and held in the compartment. If less than nine balls are to be used, the captured ball can be replaced by an appropriate indicator, such as a disk or the like.

The preferred embodiment as shown in the drawings comprises a tubular frame comprised of an angled front face, lower sides that sit on the ground and a vertical rear support section connecting the sides to the top of the front face. This overall arrangement is shown in the side view of FIG. 4. The frame can be formed in many manners. For a game, which can be sold at retail, the frame needs to be made in parts so that a consumer can carry and transport the box holding the product. This can be accomplished by creating the entire frame out of a series of tubular portions such as plastic pipe sections. Horizontal frame components 1 through 12 and vertical frame components 13 through 24 are interconnected with corner "L" joints 25 through 28, intermediate "T" joints 29 through 36, and interior cross-shaped joints 37 through 40. The particular sizes of the components are not critical to the invention, as long as each ball-receiving compartment is larger than the ball being kicked. In a typical case, a standard size 5 soccer ball is used in the game, and each compartment has a length of about twenty four inches and a height of about twenty four inches.

Figure 2:
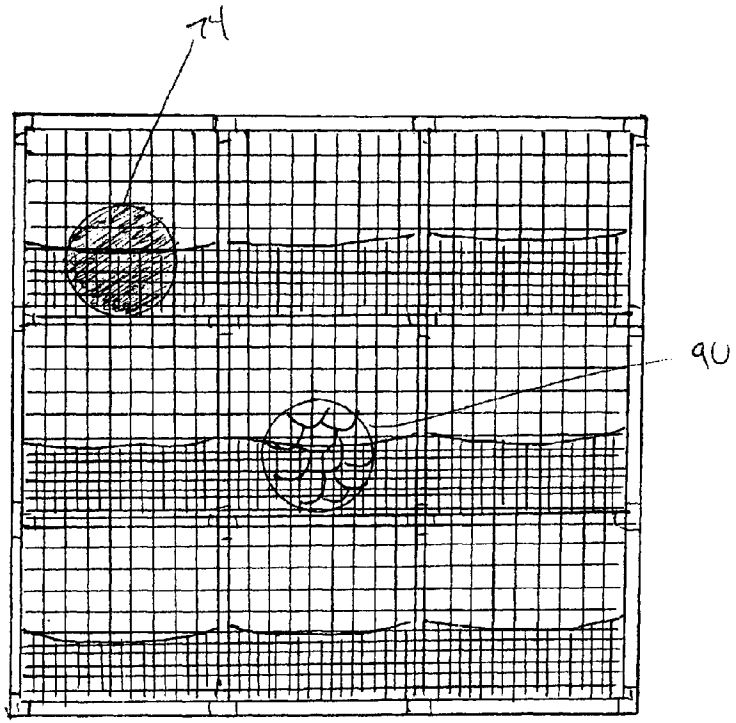
FIG. 2 is similar to FIG. 1, but with the inclusion of the ball in one compartment, and one of the possible compartment possession indicators shown in another pocket.

Preferably, a single piece of netting is attached to the four outer sides of the frame and each of the horizontal and vertical frame components 1 through 24 to form ball-catching pockets that close each of the nine compartments. The net attachment can be accomplished with hook- and loop-type fabric strips, or tied with string or tie-wraps or the like. Pockets can be formed at the bottom of each compartment by also attaching a smaller strip of netting 51 through 59 horizontally at the lower portion of each compartment. This forms pockets to capture ball 90 as shown in FIG. 2. There could be nine strips, or three strips, one for each row. These strips are attached to the frame in the same manner as is the large net.

Figure 3:
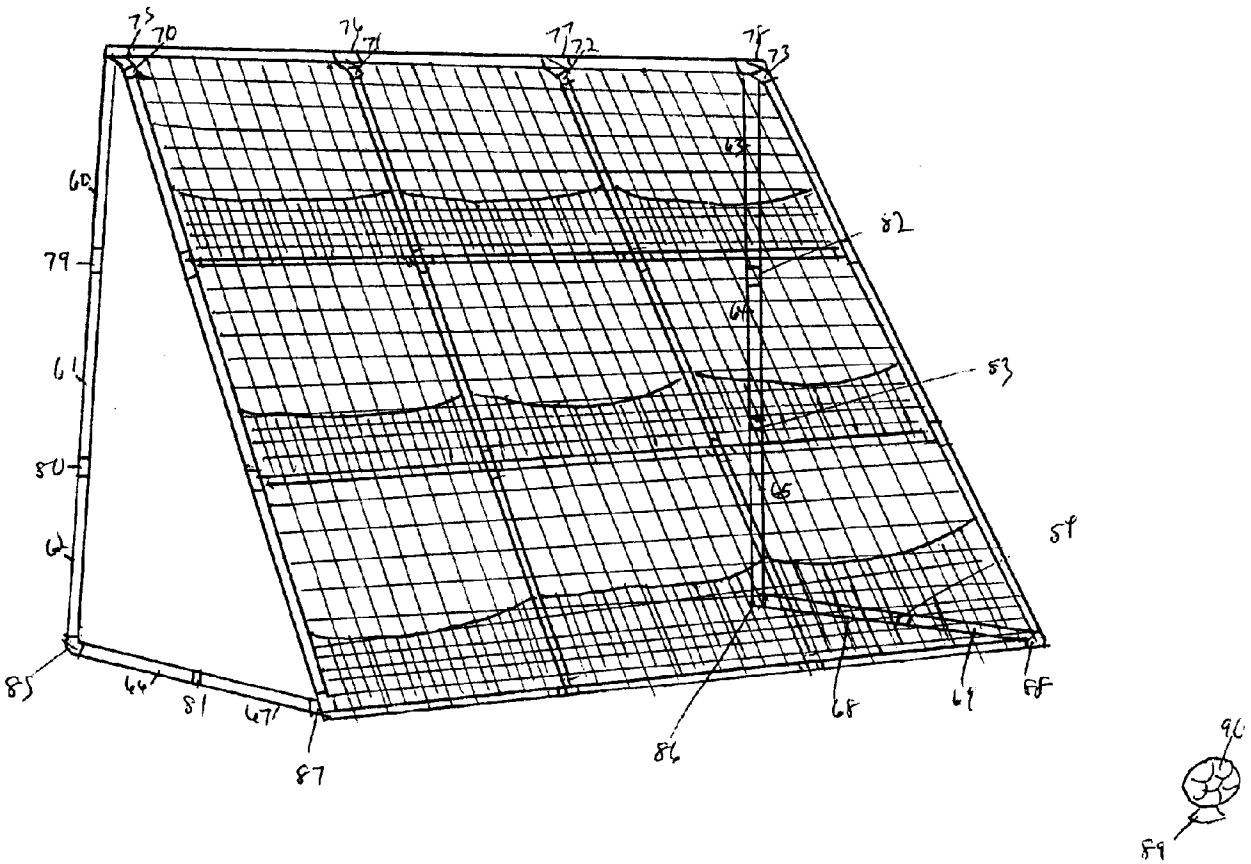
FIG. 3 is a perspective view of the device of FIG. 1, showing the overall configuration of the goal, nets, ball and cone, plus the support braces.
Figure 4:
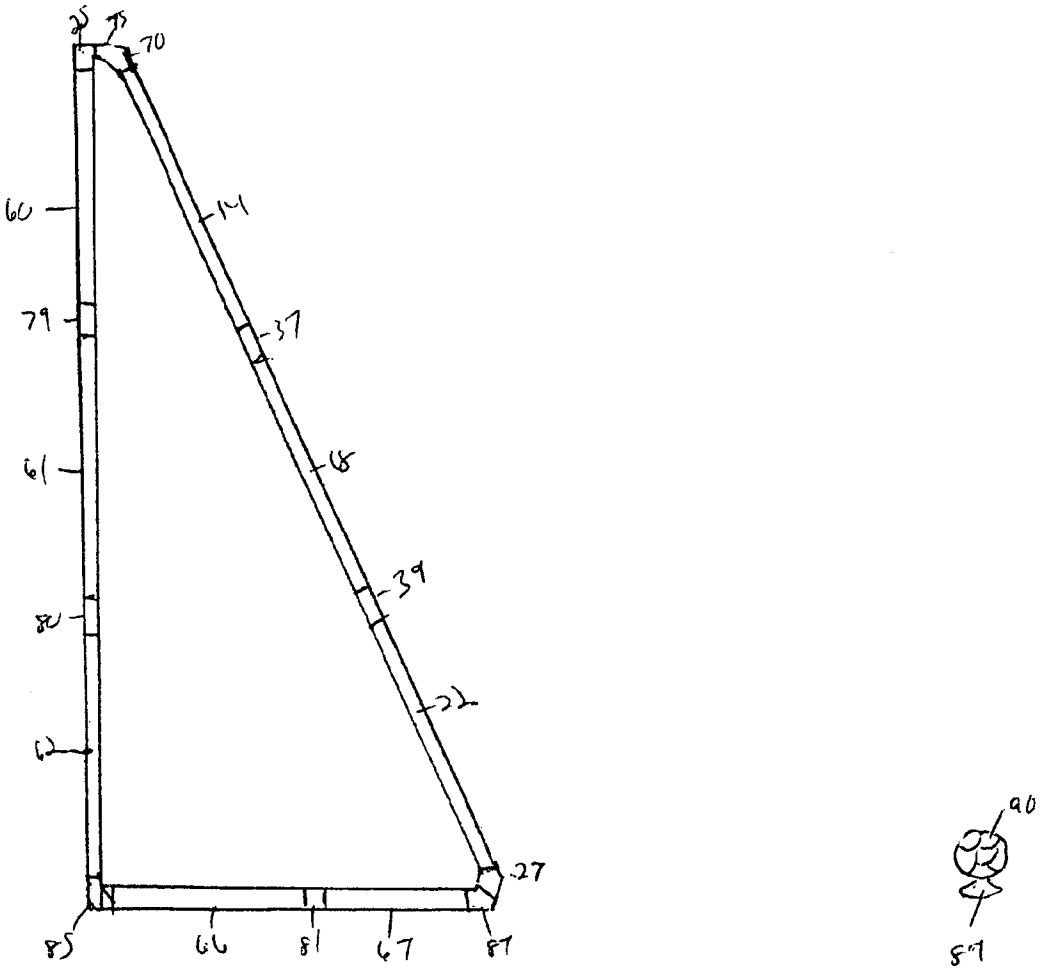
FIG. 4 is a side view of the goal of FIG. 1, illustrating the angle of the angled front of the goal, with the vertical back supporting it.

The preferred embodiment of the support structure for this ball-receiving section of the frame is shown in FIGS. 3 and 4. Vertical components 60 through 65 and horizontal components 66 through 69 are connected together with elbow joints 70 through 73 and top joints 25, 28, 29 and 30. Short connecting pipes 75 through 78 connect joints 25 and 70, 29 and 67, 30 and 68, and 26 and 69, respectively. Couplings 79 through 84 connect the vertical and horizontal support components to make up the longer braces. "L" joints 85 and 86 connect the vertical and horizontal support brackets, and 45 degree "L" joints 87 and 88 connect the front corners of the frame with the bottom support braces. Cone ball stand 89 can be used to provide the ball at a consistent height for kicking, although obviously the ball could be kicked from the ground as well.

FIG. 2 also depicts a marker 74 as placed in one compartment that has been captured by the ball. The markers can be disks that are about the same size as the ball, or any other visible marker that can be held in the pocket to indicate the possession of the square by a player or a team. The markers could carry "X" and "O" indications to replicate the marks that are typically used in tic-tac-toe.

The game can be played by having players either kick, throw, or bounce a ball with the aim of trying to have the ball captured in one of the nine ball-receiving compartments. The players or teams take turns. The objective is to capture three consecutive compartments, as in tic-tac-toe.

The frame can be constructed in any convenient member. Another version of the invention contemplates a frameless version in which the netting is configured to be attached to another structure, such as a swing set or a garage door frame. The ball-receiving areas could be defined in the netting or the frame in any convenient manner. For example, the pocket-defining netting strips could, themselves, without intervening frame sections, define ball-receiving areas. Thus, the device could simply be a large netting with nine-evenly-spaced pockets arranged thereon.

Other embodiments will occur to those skilled in the art and are within the following claims.

What is claimed is:

1. A method of playing a game involving kicking a ball into a target, comprising:

providing a target comprising a netting having a plurality of pockets, each of which can hold the ball;

kicking a ball toward the target, with the aim of the ball lodging in one of the pockets; and indicating a player's possession of a pocket once the ball is successfully kicked into such pocket by placing a physical indicator other than the ball into the pocket.

2. The game-playing method of claim 1 wherein the target defines nine contiguous ball-receiving areas, and there is a pocket for each area.

3. The game-playing method of claim 2 wherein the areas are defined at least in part by a frame.

4. The game-playing method of claim 1 wherein the target further comprises a frame adapted to sit on the ground, for holding the netting at an angle to the ground.

5. The game-playing method of claim 1 wherein the target further comprises a frame defining an opening in which the netting is located, and a structure dividing the frame opening into a number of contiguous ball-receiving areas.

6. The game-playing method of claim 5 wherein the structure comprises two vertical and two horizontal members attached to the frame.

7. The game-playing method of claim 5 wherein the ball-receiving areas are all substantially the same size.

8. The game-playing method of claim 1 wherein the pockets are created with flexible strips.

9. The game-playing method of claim 8 wherein the flexible strips comprise netting.

10. The game-playing method of claim 5 wherein the frame comprises a number of interfitting frame pieces.

11. The game-playing method of claim 5 wherein the target further comprises a stand for holding the frame.

12. The game-playing method of claim 11 wherein the stand holds the frame at an angle to the vertical.

13. The game-playing method of claim 12 wherein the angle is less than 45 degrees.

14. The game-playing method of claim 5 wherein the frame is substantially rectangular.

15. The game-playing method of claim 1 wherein the target further comprises a substantially rectangular frame defining an opening in which the netting is located, a plurality of vertical members and a plurality of horizontal members that divide the frame opening into a number of contiguous, substantially rectangular ball-receiving areas, and a plurality of netting strips define the spaced pockets that are created between the strips and the main netting.

* * * * *